United States Patent [19]

Gentes et al.

[11] Patent Number: 4,993,082

[45] Date of Patent: Feb. 19, 1991

[54] METHOD FOR MAKING HELMET WITH INDELIBLY ORNAMENTED COVER

[75] Inventors: James J. Gentes, Soquel; Steven K. Sasaki, Santa Cruz, both of Calif.

[73] Assignee: Giro Sport Design, Inc., Soquel, Calif.

[21] Appl. No.: 461,496

[22] Filed: Jan. 5, 1990

[51] Int. Cl.[5] ..... A42B 3/00

[52] U.S. Cl. ..... 2/410; 2/187; 2/422

[58] Field of Search ..... 2/187, 410, 422

[56] References Cited

U.S. PATENT DOCUMENTS

| | | | |
|---|---|---|---|
| Re. 29,742 | 8/1978 | Tung | 2/412 |
| 2,293,308 | 8/1942 | Riddell, Sr. et al. | 2/410 |
| 3,245,087 | 4/1966 | Marchello | 2/422 |
| 3,445,860 | 5/1969 | Rodell | 2/422 |
| 4,271,537 | 6/1981 | Bowlus et al. | 2/424 |
| 4,599,752 | 7/1986 | Mitchell | 2/425 |

FOREIGN PATENT DOCUMENTS

| | | | |
|---|---|---|---|
| 3619282 | 12/1987 | Fed. Rep. of Germany | 2/422 |

*Primary Examiner*—Werner H. Schroeder
*Assistant Examiner*—Michael A. Neas
*Attorney, Agent, or Firm*—Rosenblum, Parish & Bacigalupi

[57] ABSTRACT

A helmet having a molded cover shell for decorating and protecting the exterior surface of a helmet body is formed from a helmet body and a thin clear plastic sheet of material molded in the shape of the upper exterior portion of the helmet's body and painted or colaminated on the interior surface of the cover prior to being fitted and affixed to the helmet's body, thereby giving the cover's decorative design a deep luster, and protecting both the helmet's exterior surface and the cover's decorative appearance.

7 Claims, 2 Drawing Sheets

METHOD FOR MAKING HELMET WITH INDELIBLY ORNAMENTED COVER

BACKGROUND OF THE INVENTION

1. Field of the Invention

The present invention relates generally to covers, for helmets and more particularly to a method for making a durable, indelibly ornamented helmet cover.

2. Brief Description of the Prior Art

General utility foam molded helmets were first introduced on the market by Applicant in 1985. These helmets were not only lightweight and stylishly designed, but also offered surprisingly effective head injury protection, especially to bicycle riders. By injection molding the helmet body out of foam, injected at a density of about 5 ½ pounds per cubic foot, Applicant was able to create a rigid, light-weight bicycle helmet body that would meet and exceed all applicable safety standards for such helmets. These helmets, weighing approximately 6 ounces, were not only found to protect riders involved in high range collisions (i.e., a 50–60 mile per hour collision with a wall), but also those involved in low range collisions (i.e., falls from 4–5 feet from the ground).

Since the foam body of the helmet was not outwardly attractive in appearance, a fabric cap was placed over the foam body to cover the foam, to decorate the helmet in different colors, and to identify the manufacturing source of the product. Although these covers were intended to serve as an ornamental accessory to the helmet, the covers also provided some minor incidental protection for the foam body, such as to prevent and/or hide dents or nicks in the foam.

When a foam helmet is involved in an accident or collision, the foam body will occasionally break into two or more pieces upon impact. Although the fabric covers could not prevent the helmet from breaking into pieces, if the type of impact was one which would cause such a result, the cover might occasionally help to retain the broken pieces of the helmet on the wearer's head after impact. However, since the covers were not designed for such a purpose and have not proven to be effective in this regard, different means have been sought to either improve the rigidity of the helmet structure during most impacts or to better hold the resulting broken pieces together. An additional problem with the fabric covers is that the fabric material is prone to snagging on branches and the like when the fabric covered helmet is used by mountain bicycle riders.

One effort to improve the body's rigidity has involved molding the foam body around an internal webbing or infrastructure, which still allows the helmet to break apart upon impact (a force absorbing action which often prevents major head injury), but still keeps the loose pieces together in order to maintain the basic form of the helmet. A second effort has involved replacing the fabric cap with a durable cover or shell. The resilient nature of the cover further strengthens the helmet body and, if an adhesive is used to affix the cover to the body, keeps the helmet from breaking apart. However, because it is very important to keep the helmet as light as possible, the heavy plastic covers typically used on many hard shell type helmets are undesirable for use on foam helmets.

Another disadvantage of the hard shell type helmet cover is that the hard shell cover is more difficult to decorate in a manner similar to that of the fabric covers, the appearance of which have gained wide popularity. The different techniques that have been used to decorate these and other covers include coloring the plastic compound used to form the cover or painting the outside of the helmet. Multicolored plastic shells are more expensive, do not provide as many design options, and may be easily scratched and soiled, thereby detracting from the attractiveness of the cover. Painted covers can also be easily scratched and soiled through normal use.

In an effort to help prevent the paint of painted covers from being scratched or rubbed off, some covers have been coated with a clear protective coating of paint. However, since this coating, like the paint base, is also adhered to the plastic cover, it is just as likely to be scratched off as the paint and therefore provides little improvement. Another disadvantage of a painted cover is that the cover generally appears to be painted, thereby giving the cover a rather lusterless appearance and causing it to lack some of the stylish nature associated with the popular fabric covers.

SUMMARY OF THE PRESENT INVENTION

It is therefore an object of the present invention to provide a novel durable cover for a foam helmet body which can be indelibly colored or decorated with a wide variety of designs.

Another object of the present invention is to provide a novel method for ornamenting a foam helmet body to give it a unique decorative appearance.

A further object of the present invention is to provide a lightweight helmet cover for improving the rigidity and adhesiveness of a foam helmet's body.

Briefly, the preferred embodiment of the present invention comprises a helmet having a cover of a thin clear plastic sheet of resilient material molded in the shape of the upper exterior portion of a helmet s body and painted or colaminated on the interior surface of the cover prior to being fitted and affixed to the helmet's body, thereby giving the cover's decorative design a deep luster, and protecting both the helmet's exterior surface and the cover's decorative appearance.

These and other objects of the present invention will no doubt become apparent to those skilled in the art after having read the following detailed disclosure of a preferred embodiment which is illustrated in the several figures of the drawing.

DESCRIPTION OF THE PREFERRED EMBODIMENT

Figure 1:
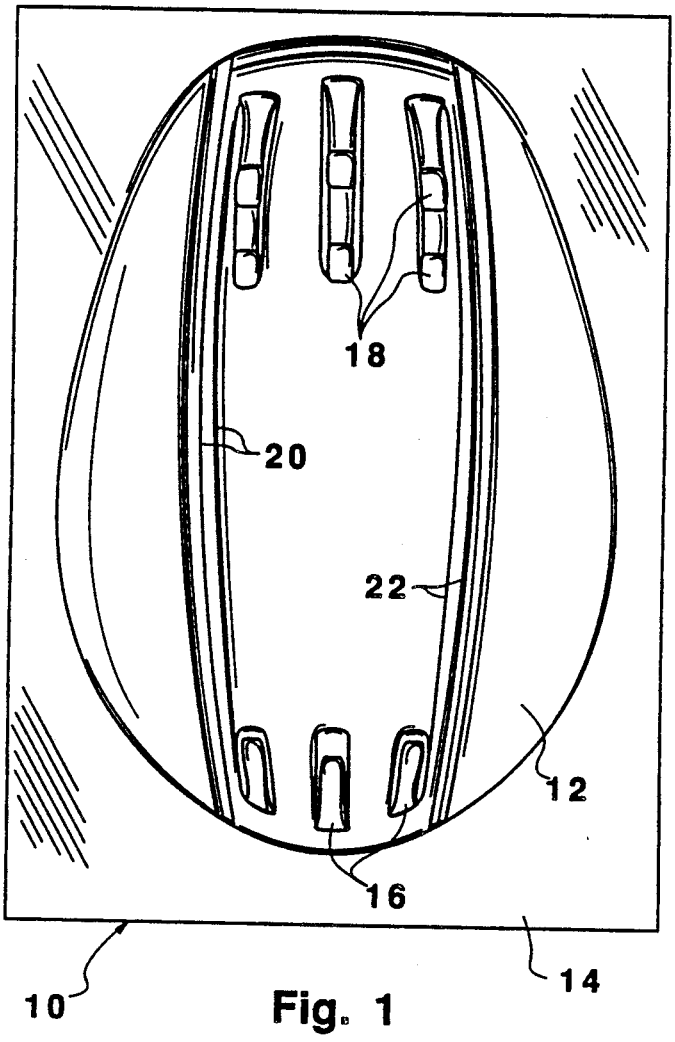
FIG. 1 is a plan view of the top of a clear helmet cover in accordance with the preferred embodiment of the present invention.

Referring now to FIG. 1 of the drawing, there is shown a plan view of a clear plastic molding 10 used in the formation of a decorative helmet cover for a foam helmet body or other type of helmet. The plastic material of the cover is typically formed from PETG or a similar type of substance, which forms a thin, clear, resilient, but highly reflective surface. The plastic material is typically two-tenths of an inch thick, but can be considerably thinner, such as 15-thousandths of an inch in thickness, if desired. It should be noted that for purposes of the present invention, a thicker plastic material is preferred because the thicker material will enhance the appearance of the finished cover, as will be further explained below.

The form of the molding 10 when first formed originally includes the cover shell 12 and a retainer 14. The retainer 14 does not form a part of the finished cover, but rather merely provides a means for handling the cover shell 12 as it is manipulated prior to being affixed to the helmet body. The retainer 14 can be cut away from the cover shell 12 either before or after the cover is fit onto the helmet body.

Generally, the most dominating factor regarding the cover shell's shape relates to the design of the helmet body over which the cover shell 12 is to be placed. For example, since the helmet body (not shown) over which the cover shell 12 is to be placed has three front air vents and six rear air vents, the cover shell 12 has indentations 16 for three front air-holes and indentations 18 for six rear air-holes. The indentations 16 and 18 are hereinafter referred to as air-hole forming because they do not form complete apertures through the cover shell 12 until a thin layer of plastic material (a shield) formed at the base of the indentation is cutout. The step of removing the indentation shield can occur either prior to or after the cover is placed on the helmet body.

As stated, the unitary cover shell 12 is molded so as to mate with the helmet body (not shown) over which it is to be placed. Hence, because the helmet body to which the cover shell 12 is intended to mate is divided into three sections by divider lines one-third of the way up the body, the cover shell 12 is likewise divided into three sections, two side panels and a center panel, by styling divider lines 20 and 22. Although the helmet cover of the present invention is illustrated as it would be used for a standard size helmet having a plurality of external air passages and divided into three sections, the helmet cover could also be formed to be used on any of a wide variety of different types of helmets, such as helmets without air-holes, streamlined helmets, and helmets with other shapes.

Figure 2:
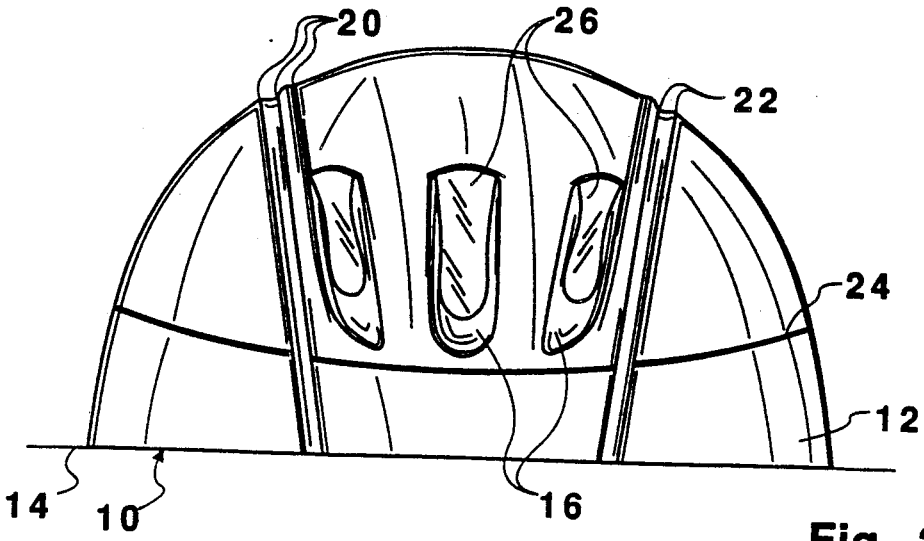
FIG. 2 is a front elevational view of the clear helmet cover of FIG. 1 illustrating some of its air-hole forming indentations.

A front view of the cover molding 10 is further depicted in FIG. 2. The cover shell 12 has the air-hole forming indentations 16 and panel styling divider lines 20 and 22, as previously described, and also has an additional styling line 24 circumscribing the cover portion, which corresponds to a similar styling line on the helmet body. As depicted, the indentations 16 are more clearly illustrated to have a flat interior portion or shield 26 at the bottom of each indentation 16. This shield 26 prevents paint or other substances from passing from the interior of the cover 12 to its exterior when it is being decorated. Similar shields are formed at the bottom interior of the rear indentations 18 for the same reason. After the interior of the helmet cover has been decorated, the shields may be cut out from the bottom of the indentations.

Figure 3:
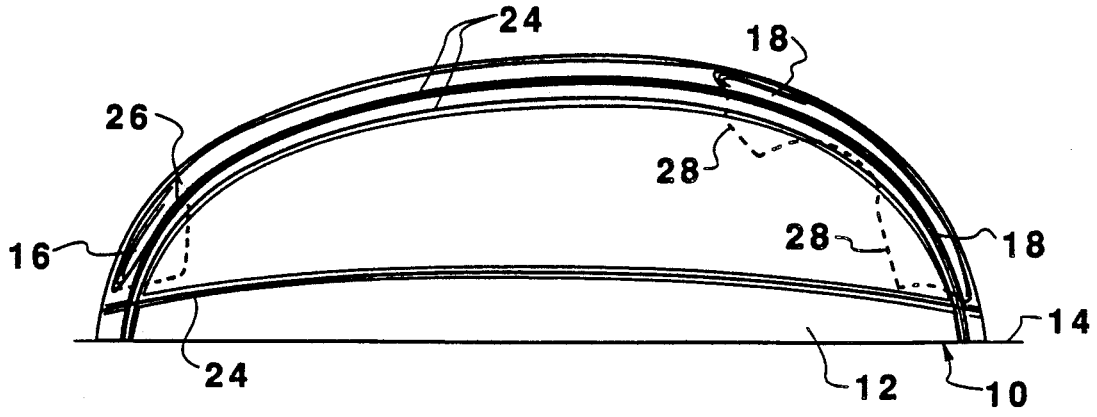
FIG. 3 is a side elevational view of the clear helmet cover of FIG. 2 further illustrating additional air-hole forming indentations.

FIG. 3 is yet another depiction of the cover molding 10, as shown from its left side. This view illustrates some of the same features depicted in FIG. 2, but also illustrates an interior shield 28 in the rear indentation 18. It should be noted that only one rear indentation 18 is depicted because a complete illustration of all indentations would make it difficult to visualize the distinct features of that one indentation. These features would be difficult to visualize because the clear sides of the cover 12 and each of the clear indentations would cause each indentation to appear layered on top of the other indentations, thereby making it difficult to distinguish between them.

Figure 4:
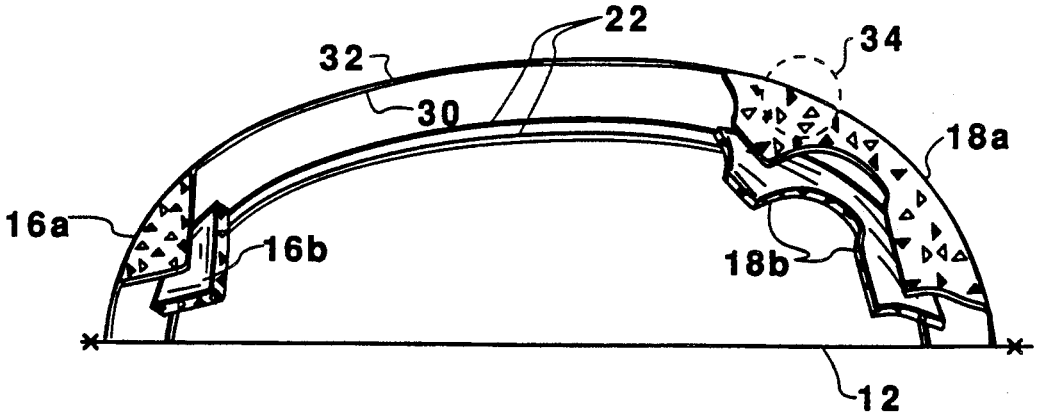
FIG. 4 is a partially-broken, side elevational view of a painted or laminated helmet cover illustrating both the inside and exterior surfaces of the cover.

A colored helmet cover shell 12, which has been cut in half lengthwise and depicted as partially-broken from its left side is shown in FIG. 4. The cover shell 12 can be ornamented in a number of different manners, such as by applying a paint through silk screening or spray painting. Alternatively, it can be ornamented with a number of different colors by masking and silk screening or spray painting the inside portion of the cover in sections, such as by ornamenting the side panels one color and the center panel a second contrasting color. The inside of the cover can also be decorated in this manner with designs, names, slogans, or any of a number of different ornamentations. Beside silk screening or spray painting the inside of the cover, the coloring or design can also be produced by laminating a single piece or different colored pieces of plastic-like material on the inside of the cover portion 12. As depicted in FIG. 4, the cover shell 12 is colaminated with a layer of laminate plastic 30 placed on the interior surface of the plastic material 32. Silk screening and colamination are the preferred methods for applying the ornamentation. Silk screened, spray painted, printed or laminated material can also be combined in any of a number of different manners to create other visual ornamentations for the cover 12.

The ornamentation described in the preceding paragraph may be added before or after the clear plastic molding 10 is formed into the shape of the cover shell 12. In the preferred embodiment, the ornamentation is added before the plastic molding 10 is formed into the shape of the cover shell 12. This technique reduces the difficulty and expense of ornamenting the cover shell 12.

Since the outer design of the cover shell 12 is protected by the plastic material 32, rather than simply being coated with a thin film of clear paint, the cover portion 12 can be decorated in any of a number of different styles without fear of having the design ruined through usage of the helmet. Because the colored material of the design is viewed through the clear but shiny plastic material of the cover, the color of the design appears deeper and more reflective than would a normally painted surface. This appearance is illustrated, in part, by the area encircled by the dotted line 34 of FIG. 4. The thicker the plastic material of the cover, the deeper the appearance achievable for the design.

The cover 12 is illustrated in FIG. 4 cut in half along its length. In addition, the indentation shields are removed from the bottom of the indentations 16 and 18, so that the cover appears more like it would when affixed to the helmet body. Because the cover is cut in half, it is possible to see the painted interior surface of the cover as well as portions of its exterior surface at the same time. For example, since the front and rear indentations **16*a* and 18*a* located along the central length of the cover are cut in half, the decorated exterior surfaces (illustrated by a pattern of hollow and filled triangular designs) of the remaining indented portions are clearly visible. Likewise, the decorated surface of the cover is also visible through the ventilation holes cut out of the indentations 16***b* and 18*b*. As will be noted by the mirroring lines, such as those depicted in the area 34, when the decorated surface is viewed looking through the clear plastic material of the cover shell the decorated surface takes on the deep luster referred to above.

Because only the thinnest coat of paint or plastic laminate is required to create the desired appearance, the paint or plastic is more flexible and is less likely to crack or separate than would be the case with thicker material. Preferably, when the cover shell 12 is painted, the paint is applied at a thickness between 1 and 3 thousandths of an inch. When the cover shell 12 is laminated, the plastic is laminated at a thickness of up to 5 thousandths of an inch. Given that the plastic material has a thickness of only 15 thousandths of an inch, the ratio between the coloring layer and the plastic layer can be as small as 1:15 to as large as 1:3 and still achieve the desired visual effect of the present invention.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A method for forming a helmet having a molded helmet cover for decorating and protecting the exterior surface of a helmet body, comprising the steps of:

applying a decorative layer of material to at least a portion of a thin substantially translucent layer of plastic material;

molding the plastic material into a cover shell having an interior surface shaped to fit over the exterior surface of the helmet body, wherein the decorative layer of material is on the interior surface of the cover shell and is visible from the exterior of the cover shell; and affixing the cover shell to the exterior surface of the helmet body, whereby both the helmet body and the decorative layer are protected by the cover shell, and the perceived depth of the decorative layer is enhanced by its placement under the cover shell.

2. A method for forming a helmet as recited in claim 1, wherein the step of molding the cover shell includes the step of forming a border member around the molded cover shell for supporting the cover shell when it is being handled during the affixing step.

3. A method for forming a helmet as recited in claim 2, wherein the helmet body includes at least one ventilation hole for the passage of air through the helmet body, wherein the cover shell includes at least one air-hole forming indentation molded into the cover shell and positioned so as to mate with the ventilation hole, and wherein the step of affixing the cover shell includes the steps of:

positioning the cover shell over the helmet body so as to align the air-hole forming indentation with the ventilation hole;

cutting away the border member from the cover shell; and cutting away a portion of the plastic material forming the indentation from the cover shell to allow air to pass through the cover shell and into the ventilation hole.

4. A method for forming a helmet as recited in claim 1, wherein the step of decorating the plastic material includes the step of applying a layer of paint on at least a portion of the plastic material.

5. A method for forming a helmet as recited in claim 1, wherein the step of decorating the plastic material includes the step of laminating a second plastic layer on at least a portion of the plastic material.

6. A method for forming a helmet as recited in claim 5, wherein the step of decorating the plastic material further includes the step of painting a layer of paint on at least a portion of the plastic material.

7. A method for forming a helmet as recited in claim 1, wherein the step of decorating the plastic material includes the step of applying color on at least a portion of the plastic material by silkscreening.

* * * * *